US007332865B2

(12) United States Patent
Hori et al.

(10) Patent No.: US 7,332,865 B2
(45) Date of Patent: Feb. 19, 2008

(54) DISPLAY PANEL DEVICE WITH A LIGHT-PERMEABLE FRONT SHEET

(75) Inventors: Nobuyuki Hori, Kawasaki (JP); Yoshimi Kawanami, Kawasaki (JP); Atsuo Ohsawa, Kawasaki (JP); Fumihiro Namiki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 11/541,582

(22) Filed: Oct. 3, 2006

(65) Prior Publication Data

US 2007/0090762 A1 Apr. 26, 2007

Related U.S. Application Data

(63) Continuation of application No. 11/048,813, filed on Feb. 3, 2005, now Pat. No. 7,119,479.

(30) Foreign Application Priority Data

Feb. 6, 2004 (JP) ..... 2004-031338

(51) Int. Cl.
*H01J 17/49* (2006.01)

(52) U.S. Cl. ..... 313/587; 313/582

(58) Field of Classification Search ..... 313/587
See application file for complete search history.

(56) References Cited

U.S. PATENT DOCUMENTS 6,654,083 B1 * 11/2003 Toda et al. ..... 349/110
6,960,875 B2 11/2005 Morimoto et al.
2002/0025441 A1 * 2/2002 Hieda et al. ..... 428/440
2003/0007341 A1 * 1/2003 Shimamura et al. ..... 361/816
2003/0122487 A1 * 7/2003 Kwon ..... 313/586
2003/0164243 A1 9/2003 Arakawa et al.
2003/0184225 A1 10/2003 Namiki et al.

FOREIGN PATENT DOCUMENTS

| | | |
|---|---|---|
| CN | 1440234 | 9/2003 |
| EP | 1134072 A2 | 9/2001 |
| JP | 4009092 | 1/1992 |
| JP | 11338382 | 12/1999 |

(Continued)

OTHER PUBLICATIONS

Computer translation of Sato.*

(Continued)

*Primary Examiner*—Nimeshkumar D. Patel
*Assistant Examiner*—Peter Macchiarolo
(74) *Attorney, Agent, or Firm*—Staas & Halsey LLP

(57) ABSTRACT

A display panel device includes a front sheet that is glued on a front face of a plasma display panel. The front sheet includes a mesh made of a light shield member that has a blackened front surface and a plane size larger than a screen. A length between diagonal lattice points of the mesh is shorter than a cell pitch that is longer one of the cell pitches in the vertical direction and the horizontal direction of the screen. An arrangement direction of the mesh is inclined with respect to an arrangement direction of the cells in the screen.

24 Claims, 6 Drawing Sheets

FOREIGN PATENT DOCUMENTS

| | | | |
|---|---|---|---|
| JP | 11338383 | | 12/1999 |
| JP | 11340679 | | 12/1999 |
| JP | 11340680 | | 12/1999 |
| JP | 2000013089 | | 1/2000 |
| JP | 2000-077888 | | 3/2000 |
| JP | 2000-156182 | | 6/2000 |
| JP | 2000156182 | A * | 6/2000 |
| JP | 2001-22283 | | 1/2001 |
| JP | 2002-319351 | | 10/2001 |
| JP | 2001-343898 | | 12/2001 |
| JP | 2003-43937 | | 2/2003 |
| JP | 2003-295779 | | 10/2003 |

OTHER PUBLICATIONS

Computer translation of Document AE IDS Dec, 21, 2006.*
European Search Report, dated May 24, 2005, for related European Patent Application No. EP 05250566.
Korean Patent Office Action, mailed Sep. 25, 2006, and issued in corresponding Korean Patent Application No. 10-2005-10305.
Chinese Patent Office Action, mailed Dec. 21, 2006, and issued in corresponding Chinese Patent Application No. 200510007353.5

* cited by examiner

DISPLAY PANEL DEVICE WITH A LIGHT-PERMEABLE FRONT SHEET

This is a continuation application of U.S. Ser. No. 11/048,813 filed Feb. 3, 2005, now U.S. Pat. No. 7,119,479. Contents thereof are incorporated herein by reference.

BACKGROUND OF THE INVENTION

1. Field of the Invention

The present invention relates to a display panel device including a flat display panel and a front sheet that is glued on the display panel.

2. Description of the Prior Art

Technology development of a plasma display panel (PDP) that is a self-luminous device is directed to a large screen for providing more powerful display. One of the important tasks for a large screen is weight reduction of the panel.

In general, a display device including a plasma display panel has a filter plate having a base of a tempered glass. This filter plate is arranged in front of the plasma display panel with air gap. The filter plate has various functions of adjusting a display color optically, preventing reflection of external light, shielding electromagnetic waves, and shielding near infrared rays concerning displaying operation and a function of protecting the plasma display panel mechanically. In addition, arranging the filter plate in front of the plasma display panel is also effective for sound isolation of vibrational sounds generated by the plasma display panel.

However, the filter plate is not desired for a large screen of the plasma display panel because it has a large weight. In order to reduce a weight of the display device, another structure is suitable in which a thin filter having a base of a resin film is glued directly on the front face of the plasma display panel instead of attaching the filter plate. Japanese unexamined patent publication No. 2001-343898 discloses a front filter that includes a transparent conductive film for a measure against EMI and a anti-reflection film that is glued on the front side of the front filter.

When a thick transparent sheet is glued on the front face of the plasma display panel, light from the screen is scattered at the surface of the sheet (i.e., an interface between the sheet and air) that is farther than the surface of the panel. As a result, a phenomenon in which a contour of the highlight portion of the image may be blurred, which is called a "halation" becomes conspicuous. In addition, microscopic asperities on the front surface of the sheet may cause distortion of a reflected image of the external light.

SUMMARY OF THE INVENTION

An object of the present invention is to reduce a weight of the display panel device while reducing the halation. Another object of the present invention is to provide a light-weighted display panel device having shock impact resistance and little distortion of the reflected image of the external light.

According to an aspect of the present invention, a light-permeable front sheet that is glued on a front face of a display panel includes a mesh made of a light shield member that has a blackened front surface and a plane size larger than a screen. The mesh cuts a part of light that is spreading out in the direction along the interface after being reflected repeatedly between the front interface and the rear interface of the front sheet so that halation is reduced. As visible light passes the mesh, so there is no problem to the display. A transmittance of the mesh is selected so that the halation is reduced sufficiently within the range in which a predetermined luminance can be obtained. A relationship between the mesh pitch and a cell pitch of the screen is selected so that the light shield member covers all the cells. The light-permeable front sheet has a transparence for passing display light rays.

A thin film having a thickness less than or equal to 30 microns is suitable as the mesh. A method for forming the mesh pattern may be a method of removing parts of a uniform film or forming a light shield member by plating or deposition on a part of the formation surface. The mesh made of a patterned film has better flatness and uniformity of the pattern than the mesh made by a net fiber, and it is desirable because it does not increase scattering of light that may affect the halation. If the mesh is formed by a conductive member, the mesh can be used for electromagnetic wave shielding. In addition, by arranging a visible light transmittance adjusting layer in front of the mesh, return light that is reflected by the surface of the front sheet is reduced so that the halation can be improved.

By disposing a soft layer behind the mesh, it is possible to protect the mesh from an impact from an external surface. Also by disposing a hard scratch resistance layer in front of the mesh, an impact absorbing function of the plasma display panel can be obtained. In order to protect the mesh from breakage due to deformation of the soft layer, it is desirable that a thickness of the soft layer is less than or equal to 1 mm. In order to prevent the display from deformation, it is desirable to make the external surface of the front sheet a hard flat surface.

According to the present invention, a weight of a display panel device can be reduced and halation can be reduced to the same extent as a panel without a front sheet.

According to the present invention, the front sheet can be utilized for electromagnetic wave shielding.

According to the present invention, a light display panel device with shock impact resistance and little display distortion can be obtained.

DESCRIPTION OF THE PREFERRED EMBODIMENTS

Hereinafter, the present invention will be explained more in detail with reference to embodiments and drawings.

A plasma display panel that is useful as a color display device is a preferable object to which the present invention is applied.

EXAMPLE 1

Figure 1:
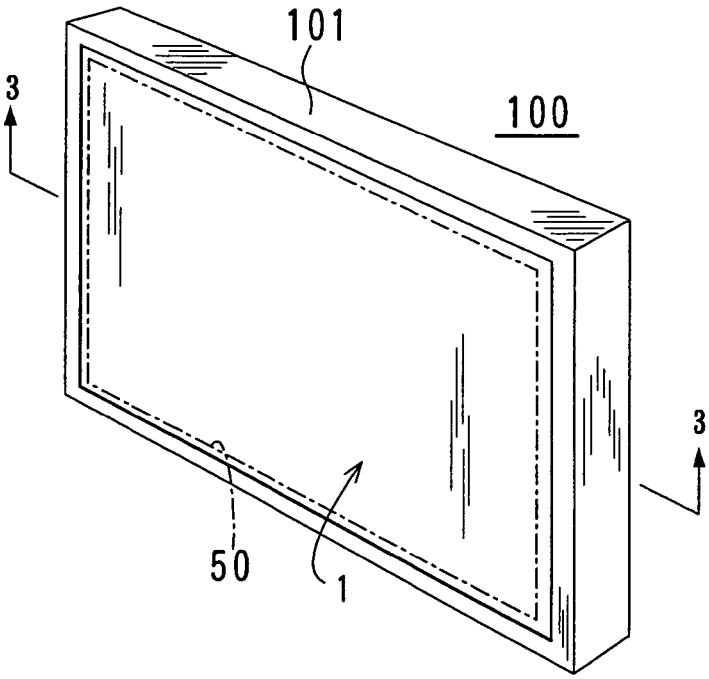
FIG. 1 shows an appearance of a display device according to the present invention.

FIG. 1 shows an appearance of a display device according to the present invention. A display device 100 is a flat type display having a 32-inch diagonal screen 50. A dimension of the screen 50 is 0.72 meters in the horizontal direction and 0.40 meters in the vertical direction. A facing cover 101 that defines a plane size of the display device 100 has an opening that is larger than the screen 50, so that a front face of a display panel device 1 is exposed in part.

Figure 2:
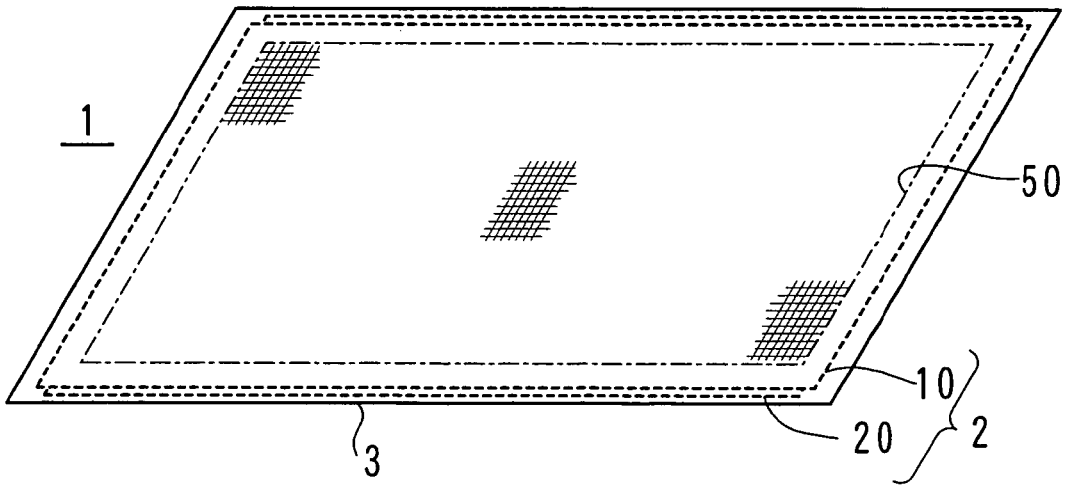
FIG. 2 shows a structure of a display panel device.

FIG. 2 shows a structure of the display panel device. The display panel device 1 includes a plasma display panel 2 that is a device that constitutes a screen and a front sheet 3 as a filter member that is glued directly on the front face of the plasma display panel 2 to be a display face. The plasma display panel 2 is a self-luminous type device that emits light by gas discharge, which includes a front face plate 10 and a rear face plate 20. Each of the front face plate 10 and the rear face plate 20 is a structural element having a base of a glass plate having a thickness of approximately 3 mm. There is no limitation of the structure of the plasma display panel 2 when embodying the present invention. Therefore, a description of an inner structure of the plasma display panel 2 is omitted here.

Figure 3:
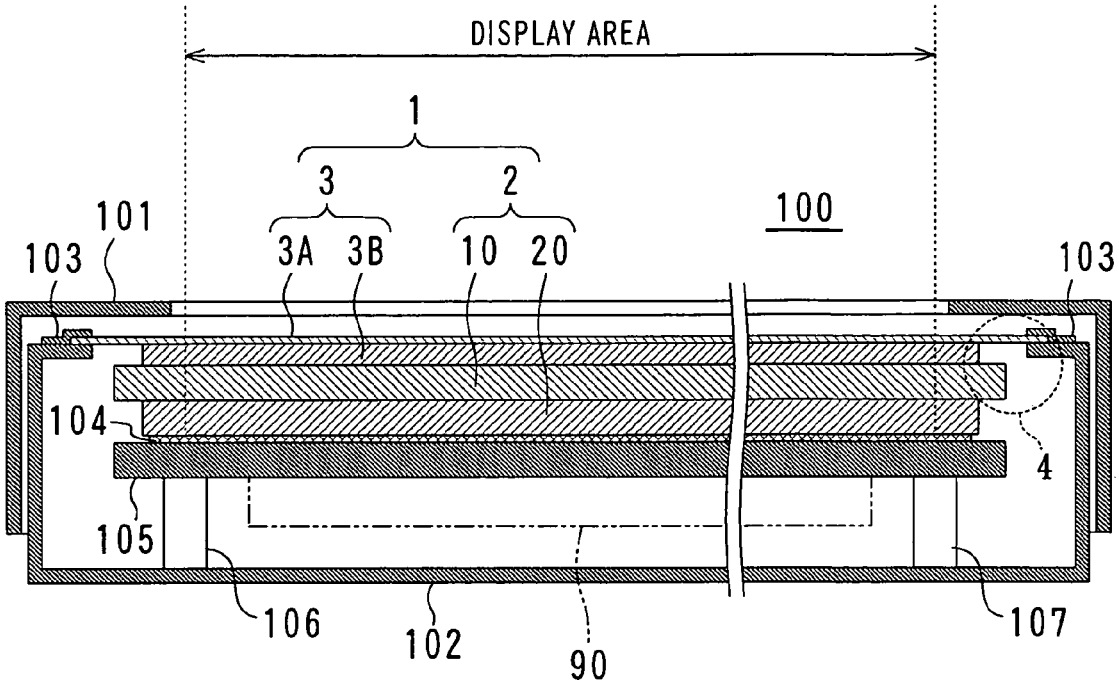
FIG. 3 shows a first example of the structure of the display panel device.
Figure 4:
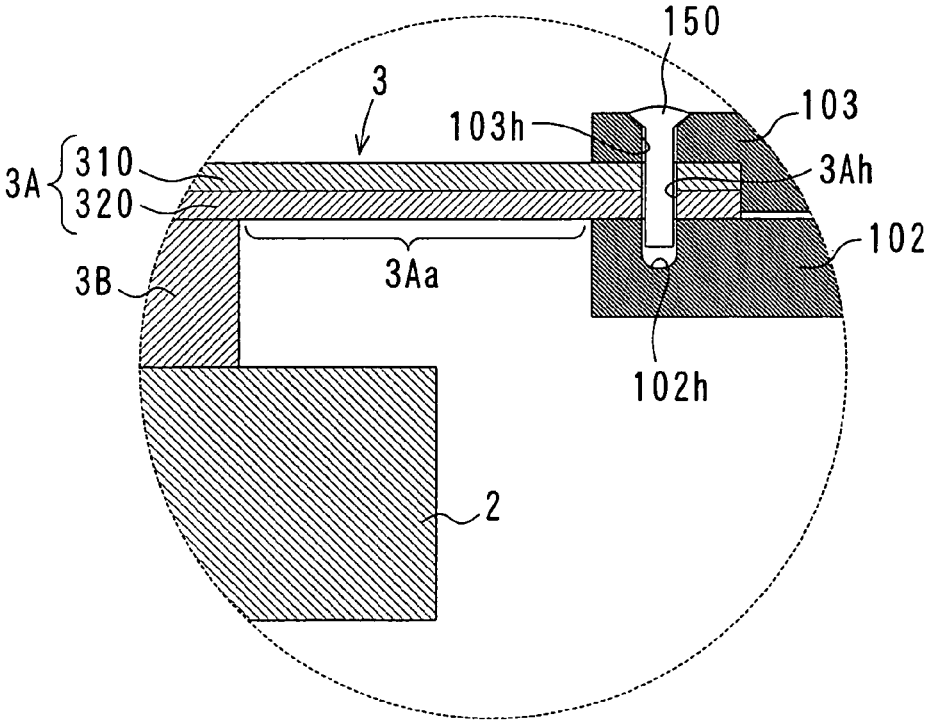
FIG. 4 shows a structure of a principal portion of the display device.
Figure 5:
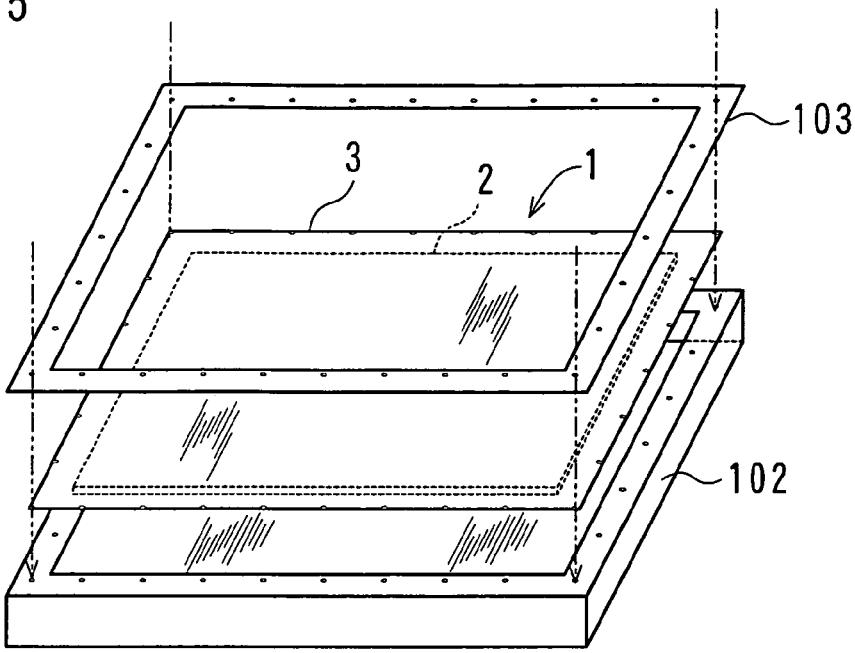
FIG. 5 shows an outline of fixing of a front sheet.

FIG. 3 shows a cross section cut along the 3-3 line in FIG. 1, concerning a first example of a structure of the display device. FIG. 4 is an enlarged view of the portion encircled by the dot-dashed line in FIG. 3, concerning a structure of a principal portion of the display device. FIG. 5 shows an outline of fixing of the front sheet.

As shown in FIG. 3, the display device 100 includes a display panel device 1 arranged in a conductive housing 102 to which the facing cover 101 is attached. The display panel device 1 is attached to a chassis 105 made of aluminum via a thermal conducting adhesive tape 104, and the chassis 105 is fixed to the conductive housing 102 via spacers 106 and 107. A driving circuit 90 is arranged on the rear side of the chassis 105. A power source, a video signal processing circuit and an audio circuit are omitted in FIG. 3.

The front sheet 3 is a flexible layered film including a front portion 3A having a thickness of 0.2 mm and having a base of a resin film, and a rear portion 3B having a thickness of 1.0 mm made of a resin layer that are put on each other, which will be described later. In particular, the thin front portion 3A that is a functional film having a multilayered structure has a good flexibility. The plane size of the front sheet 3, more specifically the plane size of the front portion 3A is larger than the plane size of the plasma display panel 2, so that the peripheral portion of the front portion 3A is positioned outside the plasma display panel 2. The plane size of the rear portion 3B is smaller than that of the front portion 3A and larger than that of the screen.

The conductive housing 102 is a metal plate formed in a boxed shape having a rectangular rear face, four side faces and a looped front face. It is also a conductive member surrounding the side faces and the rear face of the plasma display panel 2 apart from them (see FIG. 5). Inner rim of the front face of the conductive housing 102 is placed outside the plasma display panel 2 viewed from the front.

In the display device 100, the front sheet 3 extends along the plasma display panel 2 substantially in flat, and only the end portion thereof contacts the front face of the conductive housing 102. A looped pressure member 103 is disposed in front of the front sheet 3, which is sandwiched between the pressure member 103 and the front face of the conductive housing 102 so that the end portion of the front sheet 3 is fixed to the conductive housing 102. Actually, however, the end portion of the front portion 3A of the front sheet 3 is fixed to the conductive housing 102 as shown in FIG. 4. Here, the front portion 3A has an electromagnetic wave shielding layer 320 having a function of preventing halation. The electromagnetic wave shielding layer 320 is a rear side layer of the front portion 3A. A plane size of the front portion 3A is the same as that of the front sheet 3 and is larger than that of the rear portion 3B. Therefore, when the front sheet 3 is fixed to the conductive housing 102, the electromagnetic wave shielding layer 320 is connected to the conductive housing 102. The connection position thereof is apart from the plasma display panel 2.

As shown in FIG. 4 well, the plasma display panel 2 and the conductive housing 102 are connected to each other via a bridge portion 3Aa of the front sheet 3. As the front sheet 3 has flexibility, a force that is applied to the plasma display panel 2 can be relieved by deformation of the portion 3Aa when a relative position between the plasma display panel 2 and the conductive housing 102 is varied due to an impact pressure or heat. An influence on the connection between the front sheet 3 and the conductive housing 102 is also reduced. The deformation includes bending, contraction, expansion and twist.

As a method of fixing the end portion of the front sheet 3, it is preferable to use a plastic rivet 150 for mass production and reducing weight. It is preferable that the front sheet 3, the conductive housing 102 and the pressure member 103 are provided with holes 3Ah, 102*h* and 103*h*, respectively in advance, which are adapted to the rivet 150. Punching process can make many holes at the same time. Although a protrusion corresponding to a thickness of the pressure member 103 may be generated at the end portion of the front sheet 3, increase of a thickness of the display device 100 due to the protrusion is only approximately 1-2 mm.

Figure 6:
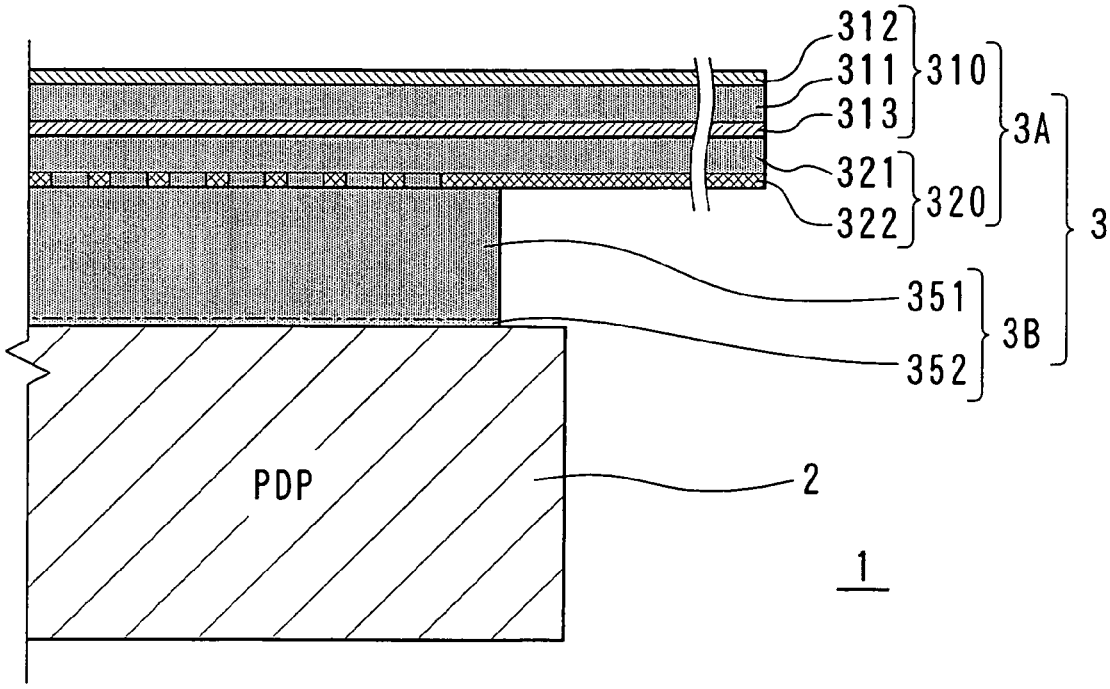
FIG. 6 shows a layer structure of the front sheet.

FIG. 6 shows a layer structure of the front sheet. The front sheet 3 is a layered film having a thickness of approximately 1.2 mm including an optical film layer 310 having a thickness of 0.1 mm, an electromagnetic wave shielding layer 320 having a thickness of 0.1 mm, an impact absorbing layer 351 having a thickness of 1.0 mm, and an adhesive layer 352 having a thickness of a few microns in this order from the front face side. The optical film layer 310 and the electromagnetic wave shielding layer 320 constitute the front portion 3A, and the plane sizes of them are the same. A visible light transmittance of the entire front sheet 3 is approximately 40% after spectral luminous efficiency correction. The impact absorbing layer 351 and the adhesive layer 352 constitute the rear portion 3B. A weight of the front sheet 3 is approximately 500 grams, so the front sheet 3 is much lighter than the conventional filter plate (approximately 4.2 kilograms).

The optical film layer 310 includes a film 311 made of a PET (polyethylene terephthalate), a anti-reflection film 312 that is coated on the front side of the film 311, and a coloring layer 313 that is formed on the rear side of the film 311. The anti-reflection film 312 prevents reflection of external light. However, the function of the anti-reflection film 312 may be changed from AR (anti reflection) to AG (anti glare). The anti-reflection film 312 includes a hard coat for increasing scratch resistance of the surface of the sheet up to pencil hardness 4H. The coloring layer 313 adjusts visible light transmittance of red (R), green (G) and blue (B) for a color display and cuts off near infrared rays. The coloring layer 313 contains an infrared absorption coloring matter for absorbing light having a wavelength within the range of approximately 850-1100 nm, a neon light absorption coloring matter for absorbing light having a wavelength of approximately 580 nm and a coloring matter for adjusting visible light transmittance in a resin. An external light reflection factor of the optical film layer 310 is 3% after the spectral luminous efficiency correction, and the visible light transmittance is 55% after the spectral luminous efficiency correction. In addition, the infrared transmittance is 10% as an average in the wavelength range.

The electromagnetic wave shielding layer 320 includes a film 321 made of PET and a conductive layer 322 having a thickness of 10 microns that is a copper foil having a mesh portion. The visible light transmittance of an area of the conductive layer 322 that overlaps the screen is 80%. As the front surface of the conductive layer 322 is black, the electromagnetic wave shielding layer 320 looks substantially coal-black when it is viewed through the optical film layer 310.

The film 311 of the optical film layer 310 and the film 321 of the electromagnetic wave shielding layer 320 have a function of preventing a glass plate of the plasma display panel 2 from scattering when it is broken in an abnormal situation. In order to realize this function, it is preferable that a total thickness of the film 311 and the film 321 is 50 microns or more.

The impact absorbing layer 351 is made of a soft resin of an acrylic system, and a visible light transmittance thereof is 90%. The impact absorbing layer 351 is formed by applying the resin. When the resin is applied, it enters spaces of the mesh of the conductive layer 322, so that the conductive layer 322 becomes flat. Thus, scattering of light that may be generated by unevenness of the conductive layer 322 can be prevented.

The impact absorbing layer 351 made of the soft resin contributes to thinning of the front sheet 3. A test was conducted in which the display panel device 1 was placed on a horizontal hard floor, and an iron ball having a weight of approximately 500 grams was dropped on the center of the screen. An impact force just before the plasma display panel 2 was broken was approximately 0.73 J. When the plasma display panel 2 without the front sheet 3 was tested under the same condition, the result was approximately 0.13 J. When the display panel device in which only the optical film layer 310 was glued on the plasma display panel 2 was tested under the same condition, the result was approximately 0.15 J. Namely, an improved portion of the shock resistance due to the front sheet 3 is approximately 0.6 J, and most of the improvement that is approximately 0.58 J is obtained by the impact absorbing layer 351. The impact absorbing layer 351 having a thickness of 1.0 mm is practical.

In this example, a rear side surface portion of the resin layer that constitutes the impact absorbing layer 351 has a function as the adhesive layer 352. The impact absorbing layer 351 has relatively strong adhesiveness to the electromagnetic wave shielding layer 320 made of PET and copper. On the contrary, the adhesive layer 352 has loose adhesiveness to the glass surface that is the front face of the plasma display panel 2. The adhesion force thereof is approximately 2N/25 mm. When the front sheet 3 is peeled, the optical film layer 310 is not separated from the electromagnetic wave shielding layer 320 so that the front sheet 3 is separated from the plasma display panel 2 normally. "Normally" means that an even peeled surface without a visible remaining matter can be obtained.

Figure 7:
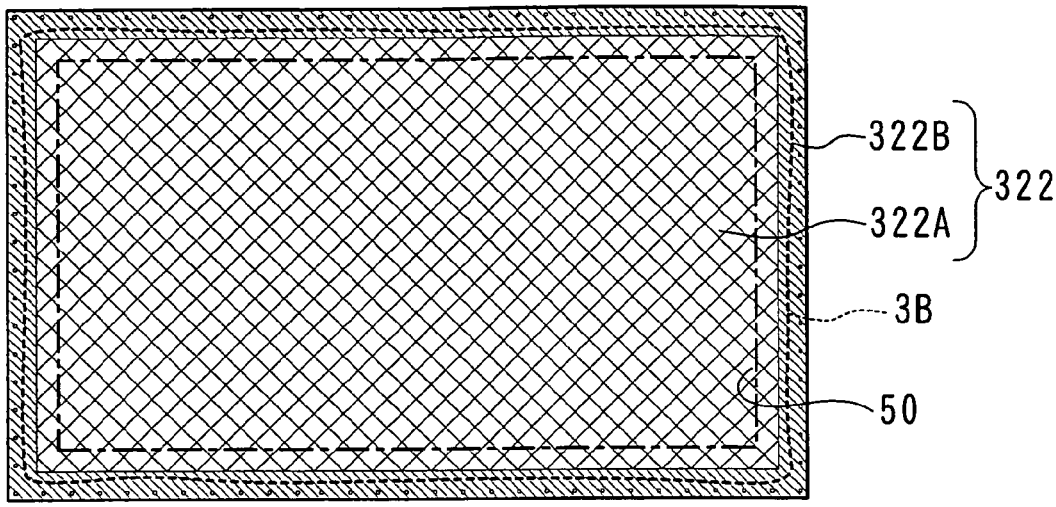
FIG. 7 shows a conductive pattern of an electromagnetic wave shielding layer schematically.

FIG. 7 shows a conductor pattern of the electromagnetic wave shielding layer schematically. The conductive layer 322 of the electromagnetic wave shielding layer is an integrated layer of a conductive mesh 322A that is put on the screen 50 and a looped conductive member 322B surrounding the conductive mesh 322A. A plane size of the conductive mesh 322A as a metal mesh pattern film of the present invention is larger than that of the screen 50. A width of four sides constituting the conductive member 322B is approximately 30 mm. The rear portion 3B of the front sheet is arranged so that the rim thereof overlaps the looped conductive member 322B along the entire length. Thus, the rim of the rear portion 3B is hidden behind the conductive member 322B when viewed from the front so that an even appearance is not deteriorated even if the contour of the rear portion 3B is something indefinite in shape. In forming the rear portion 3B, high accuracy is not required although the peripheral portion of the conductive member 322B must be exposed. A variation of approximately 10 mm can be permitted.

Note that although the conductive mesh 322A is drawn to be coarse in FIG. 7, an actual mesh pitch is substantially the same as the cell pitch of the screen 50 as being described later. It is possible to form alignment marks and rivet holes in the conductive member 322B without increasing the number of manufacturing steps of the conductive layer 322. The alignment marks facilitates the work for gluing the front sheet 3 on the plasma display panel 2.

Figure 8:
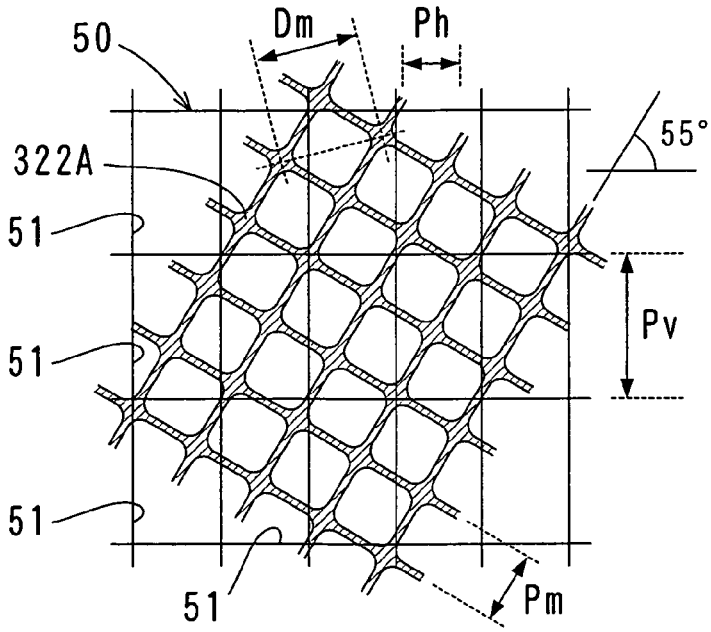
FIG. 8 shows a mesh pitch of the electromagnetic wave shielding layer.

FIG. 8 shows a mesh pitch of the electromagnetic wave shielding layer. A lattice of the conductive mesh 322A has a square pattern, and cells of the mesh are arranged in the direction that is inclined with respect to the arrangement direction of the cells 51 in the screen 50. An angle of the inclination is 55 degrees in this example. The screen 50 includes many cells 51 that are arranged in an orthogonal manner. A cell pitch Pv in the vertical direction is approximately 390 microns, while a cell pitch Ph in the horizontal direction is approximately 300 microns. In contrast, a mesh pitch Pm of the conductive mesh 322A is 280 microns. Here, a length Dm between diagonal lattice points of the mesh is approximately 350 microns, which is shorter than the cell pitch Pv that is longer one of the cell pitches in the vertical direction and the horizontal direction of the screen 50. By adjusting this pitch and the angle of inclination of the arrangement direction, the state is obtained in which all the cells 51 and a part of the mesh are overlapped. Namely, the light shield member is arranged in front of all the cells 51, so that the effect of preventing halation is obtained over the entire screen 50 substantially in a uniform manner.

Figure 9:
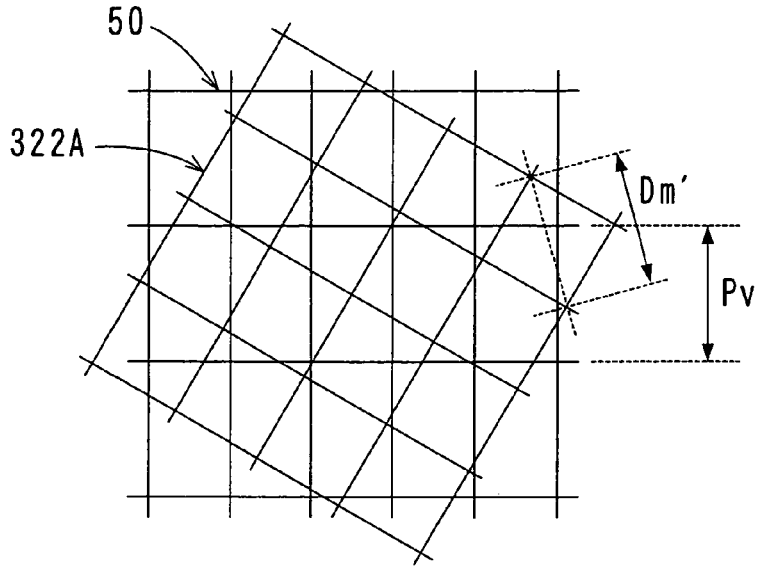
FIG. 9 shows another example of a mesh pitch.

FIG. 9 shows another example of a mesh pitch. In FIG. 9, a length Dm' between the lattice points in the diagonal direction of the conductive mesh 322A is the same as the cell pitch Pv in the vertical direction of the screen 50. In this case, all the cells 51 and a part of the mesh are overlapped. In order to make the overlap of the cells and the mesh more uniform, it is better to make the mesh pitch small. However, considering the strength and the electrical conductivity, it is desirable that a line width of the mesh is more than or equal to 10 microns. It is necessary to note that the visible light transmittance may be too small if the mesh pitch is decreased under the above condition.

EXAMPLE 2

Figure 10:
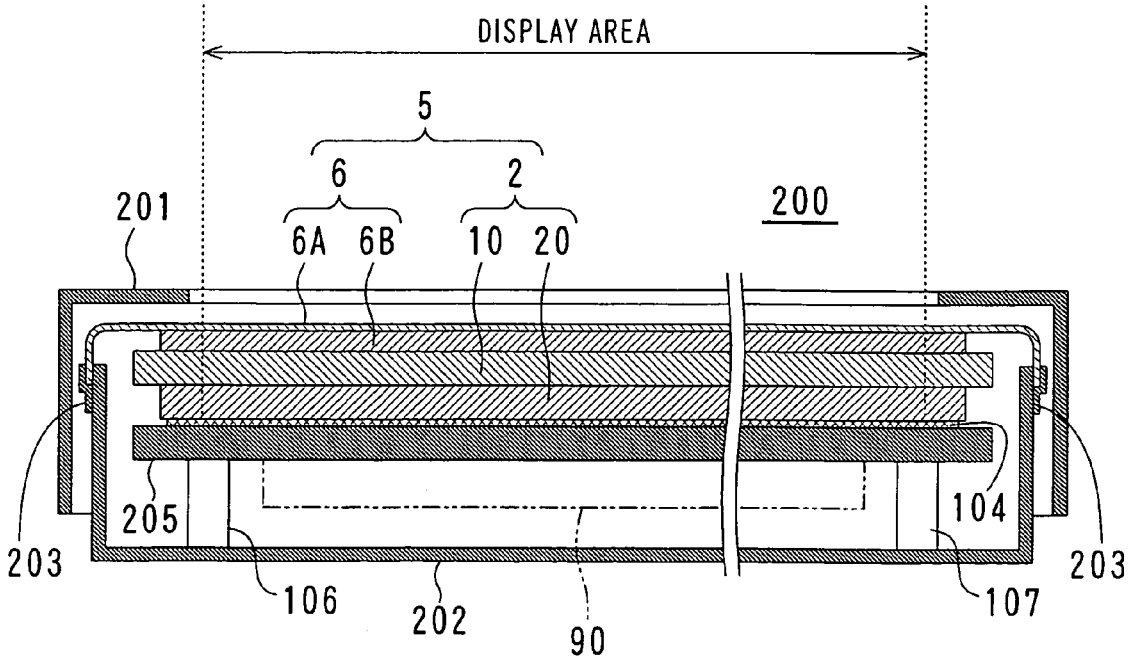
FIG. 10 shows a second example of a structure of the display device.

FIG. 10 shows a second example of a structure of the display device. A basic structure of the display device 200 is the same as the above-mentioned display device 100. In FIG. 10 and in the following drawings, structural elements denoted by the same reference numerals as in FIG. 3 are the same structural elements as the display device 100.

The display device 200 has a display panel device 5 that is a screen module. The display panel device 5 includes a plasma display panel 2 and a front sheet 6, and the front sheet 6 includes a front portion 6A and a rear portion 6B. A layer structure of the front sheet 6 is the same as in FIG. 6. In the display device 200, a plane size of the front portion 6A is larger than the above-mentioned example, and four sides of the front portion 6A are bent backward substantially in perpendicular manner, so that the end portions of the front portion 6A are fixed to a conductive housing 202. The fixing method is sandwiching the front portion 6A between the side face of the conductive housing 202 and the looped pressure member 203. The fixing position thereof is in rear of the front face of the plasma display panel 2 and away from the plasma display panel 2. In the fixing position, the electromagnetic wave shielding layer of the front portion 6A and the conductive housing 202 contact each other so that they are connected in conductive manner.

When the front portion 6A is bent, the fixing position becomes closer to the plasma display panel 2 than the case where it is not bent so that a plane size of the conductive housing 202 can be reduced. In addition, the fixing position becomes rear more than the case where the front portion 6A is not bent, so a thickness of the conductive housing 202 (size of the side face) can be reduced. Downsizing of the conductive housing 202 contributes to weight saving of the display device 200.

Note that if a factory that manufactures the display panel device 5 (a device manufacturer) and a factory that completes the display device 200 by assembling the display panel device 5 in the housing (a set manufacturer) are separated, it is necessary to prevent the front portion 6A from being damaged at the peripheral portion during transportation of the display panel device 5. For example, when the display panel device 5 is attached to the chassis 205 made of aluminum during transportation, a package size can be downsized by fixing the end portion of the front portion 6A to the chassis 205 via an insulator.

Figure 11:
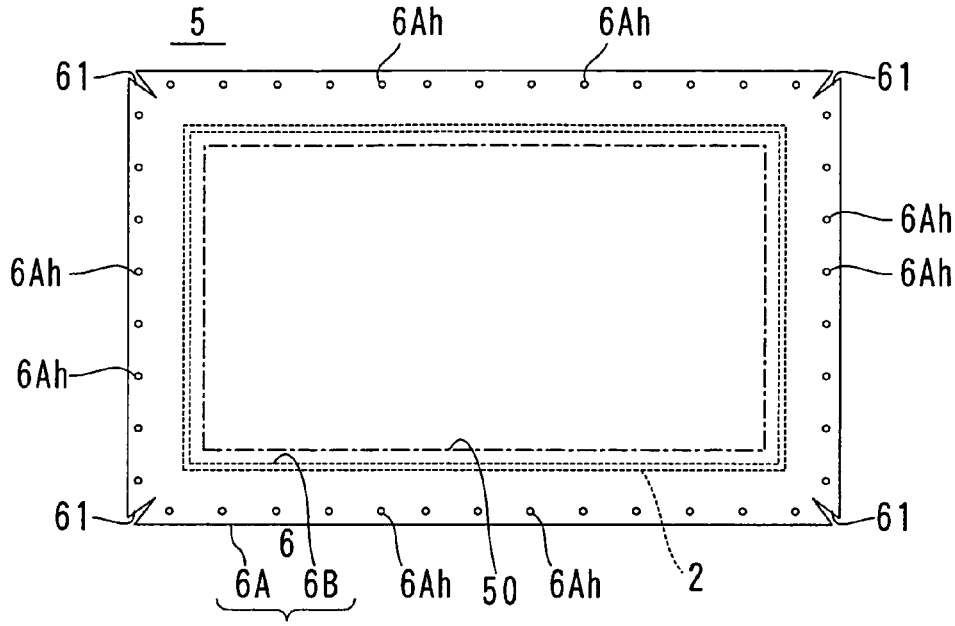
FIG. 11 shows an outline of a plane shape of the display panel device.

FIG. 11 shows an outline of a plane shape of the display panel device. The front sheet 6 of the display panel device 5 has notches 61 that are formed on four corners of the front portion 6A so as to facilitate the bending process of the front portion 6A. In addition, plural holes 6Ah are formed along the rim of the front portion 6A, and the holes 6Ah are used for fixing the front portion 6A.

EXAMPLE 3

Figure 12:
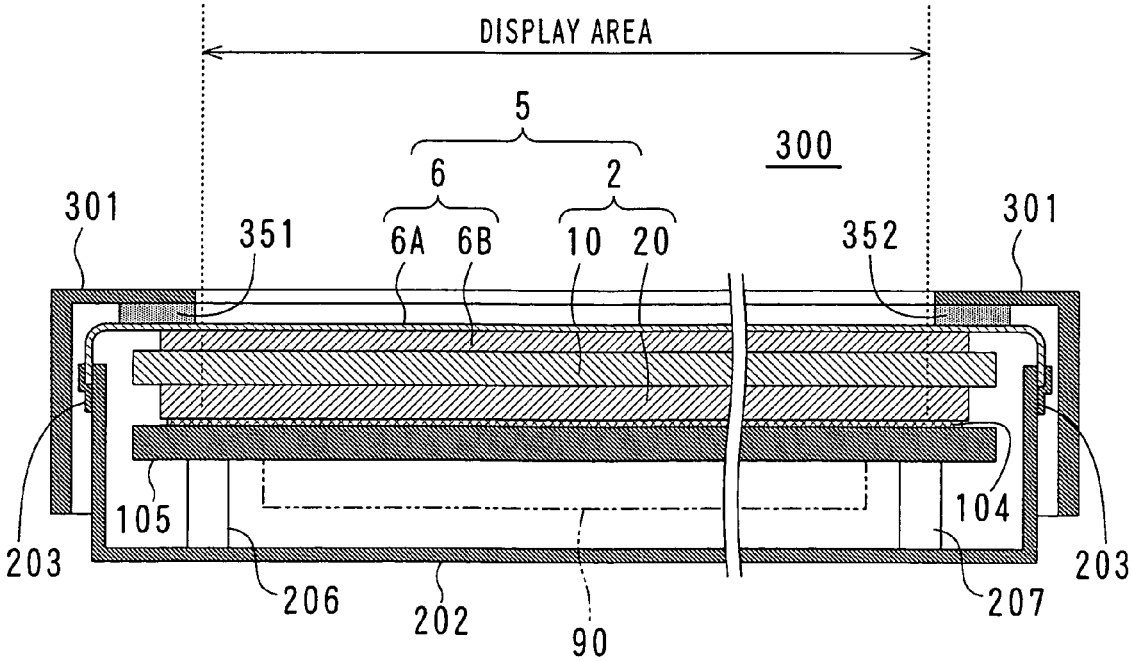
FIG. 12 shows a third example of a structure of the display device.

FIG. 12 shows a third example of a structure of the display device. A structure of the display device 300 is substantially the same as the above-mentioned display device 200. The display device 300 is characterized in that the inner rim of the front face of the facing cover 301 is close to a screen area, and sound absorbing members 351 and 352 are arranged between the facing cover 301 and the front sheet 6. The sound absorbing members 351 and 352 are glued on the facing cover 301 in advance, and the display panel device 5 is covered with the facing cover 301 so that the sound absorbing members 351 and 352 are pressed onto the front sheet 6. As the sound absorbing members 351 and 352 are flexible sponge, no excessive force is applied to the plasma display panel 2. As audible sound noises due to vibration of the plasma display panel 2 (called an abnormal sound) increases at a peripheral portion of the plasma display panel 2, the noises can be reduced substantially by arranging the sound absorbing members 351 and 352. Although the abnormal sound can be shielded by the filter plate in the conventional structure in which the filter plate is arranged in front of the plasma display panel, the sound can be reflected by the filter plate and propagate from the rear side to the front side. On the contrary, as the abnormal sound is absorbed substantially completely in the display device 300, quiet display environment can be obtained. Sounds generated by the plasma display panel 2 propagate along the rear portion 6B that is glued on the plasma display panel 2, so it is desirable to arrange the sound absorbing members 351 and 352 so as to overlap the rear portion 6B.

According to the above-mentioned first, second and third examples, halation can be reduced more than the case where the front sheet 3 or 6 is not glued. More specifically, a white color pattern of an approximately 10 cm square was displayed at a luminance of 350 cd/m$^2$, and a length from the end of the white color pattern to the end of the range in which light emission having a luminance of 1 cd/m$^2$ appears was measured as an indicator of expansion of the halation. When the front sheet 3 or 6 was glued, the halation was reduced by 0.7 times. Note that when the conventional filter plate is disposed in front of the plasma display panel away from the panel front face by 1 cm, the halation is increased by 2.5 times compared with the case where the filter plate is not arranged.

According to the above-mentioned first, second and third examples, in the conductive layer 322 of the electromagnetic wave shielding layer 320, the conductive mesh 322A that passes light and the looped conductive member 322B surrounding the conductive mesh 322A are formed integrally, so cost of the display panel device 1 or 5 can be reduced compared with a structure in which a conductive tape is attached around the mesh made of woven conductive fibers.

The above-mentioned embodiments have the following variations.

The most rear face of the front sheet 3 or 6 can be formed as an adsorption surface having a self adsorption function. For example, after forming the impact absorbing layer 351, a film made of a silicone material is formed on the surface of the impact absorbing layer 351. Thus, it is possible to repeat peeling and sticking between the front sheet 3 or 6 and the plasma display panel 2 many times. This can reduce a loss of the display panel device during manufacturing process and also contribute to maintenance after it is assembled to the display device. It is because that the front sheet can be replaced easily when it is damaged. It is also possible that only the anti-reflection layer 312 is made as a sheet having the self adsorption function and is glued on the remaining portion of the front sheet 3 or 6. A strength of the adsorption is preferably adjusted so that peeling can be done only by a force applied in the perpendicular direction, and the adsorption force is preferably 4N/25 mm or less (when peeling speed is 50 mm/min).

Instead of a silicone material, an acrylic foam material that is similar to the material of the impact absorbing layer 351 may be used, and similar effect can be obtained.

Note that a cleaning process such as using water or air injection should be performed prior to gluing the front sheet 3 or 6, if necessary, and such cleaning process should also be performed on an adsorption surface when a peeled front sheet is reused.

It is useful to design a red color fluorescent material (for example, (Y, Gd, Eu)PVO4) and a discharge gas (for example, Ne-Xe gas having Xe ratio of 5% or more and gas pressure of 500 Torr) of the plasma display panel 2 appropriately so as to reduce quantity of orange color light. If an optical filter having a narrow wavelength range of absorbing orange color light selectively can be eliminated, cost of the front sheet 3 can be reduced more.

Although a plasma display panel is exemplified in the above description, the device constituting a screen is not limited to the plasma display panel, and the prevention of halation by using the mesh can be applied to devices in which other display panels including an EL (Electro Luminescence), an FED (Field Emission Display) and a liquid crystal display constitute screens.

The present invention is useful for improving a display quality and reducing cost of a display device having a large screen and a light weight.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A display panel device, comprising:

a plasma display panel and a light-permeable front sheet that is glued on a front face of the plasma display panel, wherein the front sheet includes a mesh made of a light shield member that has a blackened front surface and has a plane size larger than a plane size of a screen of the plasma display panel, and a lattice of the mesh has a square pattern, a length between diagonal lattice points of the mesh is shorter than a cell pitch in a vertical direction and is longer than a cell pitch in a horizontal direction of the screen, and an arrangement direction of the mesh is inclined with respect to an arrangement direction of cells in the screen.

2. The display panel device according to claim 1, wherein visible light transmittance of the mesh is a value within a range of 60-90%.

3. The display panel device according to claim 1, wherein the front sheet further comprises a transmittance adjusting layer attenuating visible light in front of the mesh.

4. The display panel device according to claim 1, wherein the mesh is a patterned metal film having a uniform thickness.

5. The display panel device according to claim 4, wherein the front sheet further comprises an impact absorbing layer made of resin and disposed at a rear side of the mesh.

6. The display panel device according to claim 5, wherein the impact absorbing layer is softer than the mesh.

7. The display panel device according to claim 5, wherein the impact absorbing layer has a function of protecting the mesh from a local impact of 0.2 joule.

8. A display device, comprising:

an optical filter member on a front face of a plasma display panel;

a metal mesh pattern film, having a uniform thickness, absorbing display light reflected from the optical filter member, the metal mesh pattern film arranged between the optical filter member and the plasma display panel, and a front surface of the metal mesh pattern facing away from the plasma display panel being substantially black, wherein the metal mesh pattern film, the optical filter member and the plasma display panel are bonded integrally without interfaces with air between two of them, and a lattice of the mesh has a square pattern, a length between diagonal lattice points of the mesh is shorter than a cell pitch in a vertical direction and is longer than a cell pitch in a horizontal direction of the screen, and an arrangement direction of the mesh is inclined with respect to an arrangement direction of cells in the screen.

9. A display device for a plasma display panel, comprising:

a light permeable sheet integrally bonded to a front of the plasma display panel, said light permeable sheet comprising:

an optical film layer integrally bonded with a metal mesh pattern film layer, said metal mesh pattern film layer having a substantially black front surface facing away from said plasma display panel, and a lattice of the metal mesh pattern film layer has a square pattern, a length between diagonal lattice points of the mesh is shorter than a cell pitch in a vertical direction and is longer than a cell pitch in a horizontal direction of the screen, and an arrangement direction of the mesh is inclined with respect to an arrangement direction of cells in the screen.

10. A display panel device comprising:

a plasma display panel which includes a plurality of cells arranged in a vertical direction and a horizontal direction, and a light-permeable front sheet which is glued on a front surface of the plasma display panel, the front sheet including a mesh which is made of a conductive member, wherein the mesh has a lattice pattern, a length between diagonal lattice points of the mesh is shorter than a cell pitch in the vertical direction and is longer than a cell pitch in the horizontal direction, a plane size of the light-permeable sheet is larger than a plane size of a screen of the plasma display panel, and an arrangement direction of the mesh is inclined with respect to an arrangement direction of the cells in the screen.

11. The display panel device according to claim 10, wherein visible light transmittance of the mesh is a value within a range of 60-90%.

12. The display panel device according to claim 10, wherein the front sheet further comprises a transmittance adjusting layer attenuating visible light in front of the mesh.

13. The display panel device according to claim 10, wherein the mesh is a patterned metal film having a uniform thickness.

14. The display panel device according to claim 13, wherein the front sheet further comprises an impact absorbing layer made of resin and disposed at a rear side of the mesh.

15. The display panel device according to claim 14, wherein the impact absorbing layer is softer than the mesh.

16. The display panel device according to claim 14, wherein the impact absorbing layer has a function of protecting the mesh from a local impact of 0.2 joule.

17. The display panel device according to claim 10, wherein the cell has a rectangular shape, a longer direction of the rectangle is the vertical direction and the shorter direction of the rectangle is the horizontal direction.

18. The display panel device according to claim 10, wherein a mesh pitch in the vertical direction is shorter than the cell pitch in the vertical direction and the cell pitch in the cell pitch in the horizontal direction.

19. The display panel device according to claim 18, wherein a mesh pitch in the horizontal direction is shorter than the cell pitch in the vertical direction and the cell pitch in the cell pitch in the horizontal direction.

20. The display panel device according to claim 19, wherein the lattice pattern of the mesh is a square pattern.

21. The display panel device according to claim 10, wherein the mesh includes a blackened front surface.

22. The display panel device according to claim 10, wherein the mesh is made of a light shielding member.

23. The display panel device according to claim 10, wherein a thickness of the mesh is less than 30 microns.

24. The display panel device according to claim 10, wherein the screen of the plasma display panel is a display area of the plasma display panel.

* * * * *

UNITED STATES PATENT AND TRADEMARK OFFICE

CERTIFICATE OF CORRECTION

PATENT NO. : 7,332,865 B2
APPLICATION NO. : 11/541582
DATED : February 19, 2008
INVENTOR(S) : Nobuyuki Hori et al.

It is certified that error appears in the above-identified patent and that said Letters Patent is hereby corrected as shown below:

Column 10, Line 64, before “horizontal” delete “cell pitch in the”.

Column 11, Line 2, before “horizontal” delete “cell pitch in the”.

Signed and Sealed this

Twelfth Day of August, 2008

JON W. DUDAS
*Director of the United States Patent and Trademark Office*